US006644197B2

(12) United States Patent
Goernig et al.

(10) Patent No.: US 6,644,197 B2
(45) Date of Patent: Nov. 11, 2003

(54) PYROTECHNIC IGNITER ARRANGEMENT WITH INTEGRATED ELECTRONIC ASSEMBLY HAVING MECHANICAL SHOCK PROTECTION

(75) Inventors: Thomas Goernig, Markt-Indersdorf (DE); Holger Wulff, Ingolstadt (DE)

(73) Assignee: Conti Temic microelectronic GmbH, Nuremberg (DE)

( * ) Notice: Subject to any disclaimer, the term of this patent is extended or adjusted under 35 U.S.C. 154(b) by 0 days.

(21) Appl. No.: 10/145,399

(22) Filed: May 13, 2002

(65) Prior Publication Data

US 2002/0166473 A1 Nov. 14, 2002

(30) Foreign Application Priority Data

May 12, 2001 (DE) ..... 101 23 284

(51) Int. Cl.[7] ..... F42B 3/10; F42B 3/12; F42C 11/00; F42C 19/12

(52) U.S. Cl. ..... 102/202.12; 102/202.5; 102/202.9; 102/202.14

(58) Field of Search ..... 102/202.5, 202.9, 102/202.12, 202.14

(56) References Cited

U.S. PATENT DOCUMENTS

| | | | | | |
|---|---|---|---|---|---|
| 3,229,632 | A | * | 1/1966 | Boswell et al. | 102/202.14 |
| 4,869,170 | A | * | 9/1989 | Dahmberg et al. | 102/202.5 |
| 5,142,982 | A | | 9/1992 | Diepold et al. | 102/202.5 |
| 5,495,806 | A | | 3/1996 | Willey | 102/202.14 |
| 5,634,660 | A | | 6/1997 | Fink et al. | 280/741 |
| 5,889,228 | A | | 3/1999 | Ewick et al. | 102/275.5 |
| 5,929,368 | A | | 7/1999 | Ewick et al. | 102/215 |
| 5,942,717 | A | | 8/1999 | Pathe et al. | 102/202.2 |
| 6,079,332 | A | * | 6/2000 | Marshall et al. | 102/202.5 |
| 6,082,265 | A | | 7/2000 | Sakamoto et al. | 102/206 |
| 6,085,659 | A | | 7/2000 | Beukes et al. | 102/206 |
| 6,166,452 | A | | 12/2000 | Adams et al. | 307/10.1 |
| 6,227,115 | B1 | | 5/2001 | Gruber et al. | 102/202.9 |
| 6,302,023 | B1 | * | 10/2001 | Wier | 102/202.2 |
| 6,324,979 | B1 | | 12/2001 | Troianello | 102/202.7 |
| 6,418,853 | B1 | | 7/2002 | Duguet et al. | 102/206 |
| 6,513,436 | B2 | * | 2/2003 | Bernard et al. | 102/202.3 |
| 2002/0002924 | A1 | | 1/2002 | Duguet et al. | |

FOREIGN PATENT DOCUMENTS

| | | |
|---|---|---|
| DE | 4002088 | 8/1990 |
| DE | 4435319 | 4/1996 |
| DE | 19629104 | 7/1997 |
| DE | 19610799 | 9/1997 |
| DE | 19805539 | 8/1999 |
| DE | 19836278 | 3/2000 |
| DE | 19836280 | 5/2000 |
| DE | 19951720 | 12/2000 |
| DE | 19930904 | 1/2001 |
| DE | 19940201 | 1/2001 |

(List continued on next page.)

*Primary Examiner*—Michael J. Carone
*Assistant Examiner*—H. A. Blackner
(74) *Attorney, Agent, or Firm*—W. F. Fasse; W. G. Fasse

(57) ABSTRACT

An igniter arrangement for vehicle occupant protection devices includes a substrate, an electronic assembly on the substrate in an electronic zone, an electrical ignition bridge on the substrate in a pyrotechnic zone, and a pyrotechnic charge adjoining the ignition bridge. A shock absorbing elastic first material covers a first portion of the substrate in the pyrotechnic zone, and forms a shock-absorbing cushion between the charge and the electronic zone. A second material harder than the first encases a second portion of the substrate and the electronic assembly in the electronic zone, protects the electronic assembly, and separates the two zones. The ignition bridge and the electronic assembly are at opposite ends of the elongate substrate. A breakable parting feature separably connects the two substrate portions and breaks due to high forces arising during ignition of the charge, so these forces are not transmitted through the substrate into the electronic zone.

15 Claims, 1 Drawing Sheet

FOREIGN PATENT DOCUMENTS

| | | |
|---|---|---|
| DE | 19940200 | 4/2001 |
| EP | 0279796 | 8/1988 |
| EP | 0555651 | 8/1993 |
| WO | WO97/21067 | 6/1997 |
| WO | WO00/09964 | 2/2000 |
| WO | WO00/40917 | 7/2000 |

* cited by examiner

PYROTECHNIC IGNITER ARRANGEMENT WITH INTEGRATED ELECTRONIC ASSEMBLY HAVING MECHANICAL SHOCK PROTECTION

CROSS-REFERENCE TO RELATED APPLICATIONS

This application is related to U.S. application Ser. No. 10/145,397 filed May 13, 2002, and U.S. application Ser. No. 10,145,398 filed May 13, 2002. The entire disclosures of these two other commonly filed U.S. applications are incorporated herein by reference.

PRIORITY CLAIM

This application is based on and claims the priority under 35 U.S.C. §119 of German Patent Application 101 23 284.5, filed on May 12, 2001, the entire disclosure of which is incorporated herein by reference.

1. Field of the Invention

The invention relates to a pyrotechnic igniter arrangement with an integrated electronic assembly, especially for triggering passenger or occupant protection devices in motor vehicles, for example. The igniter arrangement includes a pyrotechnic charge or active mass operatively connected with an electrically ignitable ignition bridge.

2. Background Information

An igniter arrangement of the above mentioned general type is disclosed in German Patent Laying-Open Document DE 198 36 278 A1. According to that reference, the ignition bridge as well as an electronic assembly are arranged together on a carrier arrangement, whereby the entire carrier arrangement is arranged in the ignition capsule with the pyrotechnic charge or active mass. For protecting the carrier arrangement and the electronic assembly, the entire carrier arrangement is partially covered or coated with a shock absorbing, elastic material. The ignition bridge remains free of, i.e. is not covered by, the shock absorbing material, in order to enable the operative connection between the ignition bridge and the pyrotechnic charge.

German Patent DE 198 36 280 C1 discloses a pyrotechnic igniter arrangement, that is structurally separated by a protective wall into a pyrotechnic area or zone including the pyrotechnic charge and the ignition bridge, and an electronic area or zone including the electronic assembly. In order to connect the electronic assembly in the electronic zone with the ignition bridge in the pyrotechnic zone, separate contact elements are provided in the protective wall, whereby these separate contact elements must be contacted on both sides of the wall.

Further simpler carrier arrangements or substrates, for example circuit boards, to be used as a supporting carrier for the entire ignition arrangement including the ignition bridge and the electronic assembly, are disclosed in published European Patent Application 0,555,651 B1, for example. Using such a simple common carrier arrangement is more economical than providing separate carrier arrangements for the pyrotechnic zone and for the electronic zone respectively. However, such a simple carrier arrangement does not provide a comparably effective protection for the electronic assembly against the effects of pressure, temperature or forces that arise during the triggering or ignition of the igniter arrangement.

This can be disadvantageous, if the pressure, temperature, forces, or other mechanical influences arising from the pyrotechnic zone in turn are transmitted to the electronic assembly and lead to a disruption thereof. Namely, the igniter arrangement is typically connected via its electronic assembly to a databus, which in turn is further connected to a central unit and other igniter arrangements, for example in an ignition bus for occupant protection devices in a motor vehicle. It is desired that an igniter arrangement should remain at least partially functional even after its ignition, for example to confirm the proper ignition or the like. In any event, the electronic assembly must remain intact or undisturbed to an extent sufficient to assure that the further data exchange on the ignition bus will not be interrupted or interfered with by the igniter arrangement that has been ignited.

SUMMARY OF THE INVENTION

In view of the above, it is an object of the invention to provide an igniter arrangement which may be easily and economically manufactured, and which ensures that the electronic assembly still remains functional, even after triggering or ignition of the igniter arrangement. Particularly, it is an object of the invention to protect the electronic assembly in the electronic zone from the mechanical and thermal influences, and especially the mechanical forces, arising in the pyrotechnic zone of the igniter assembly during ignition thereof. The invention further aims to avoid or overcome the disadvantages of the prior art, and to achieve additional advantages, as apparent from the present specification.

The above objects have been achieved according to the invention in a pyrotechnic igniter arrangement with an integrated electronic assembly, comprising a carrier arrangement or substrate that extends into both a pyrotechnic zone and an electronic zone of the igniter arrangement, a pyrotechnic charge, an electrically ignitable ignition bridge arranged on a first portion of the carrier substrate in the pyrotechnic zone and operatively connected to the charge, an electronic assembly including at least one electronic component arranged on a second portion of the carrier arrangement in the electronic zone, a shock absorbing elastic first material that at least partially covers the first portion of the carrier arrangement in the pyrotechnic zone, whereby the ignition bridge itself preferably remains free of the shock absorbing first material, and a harder second material that at least partially surrounds or encases the second portion of the carrier arrangement in the electronic zone, whereby this harder second material is harder than the shock absorbing first material provided in the pyrotechnic zone.

The basic idea of the invention is to achieve the structural separation of the electronic zone and the pyrotechnic zone from each other, yet to simultaneously achieve the benefits of a simple common carrier arrangement for both the electronic assembly in the electronic zone as well as the ignition bridge in the pyrotechnic zone. Particularly, the invention provides a structural separation between the zones by encasing the carrier arrangement with respective materials having different hardnesses in the two zones, namely coating or covering the pyrotechnic zone with a shock absorbing, elastic, softer first material and encasing or completely potting the electronic zone with a relatively harder second material.

The inventive arrangement preferably comprises, within a housing, a complete encasing or potting of the pyrotechnic zone to the inner side walls of the housing with the shock absorbing first material, whereby however, the ignition bridge is of course excepted and is not completely encased in the shock absorbing material to allow its connection with the pyrotechnic charge. Similarly, the electronic zone is preferably fully encased or filled and potted out to the side walls of the housing with the relatively harder second material.

With the above described construction, although the electronic assembly is integrated into the ignition arrangement, and a single common carrier arrangement or substrate is provided for both the electronic assembly in the electronic zone and the ignition bridge in the pyrotechnic zone, a physical separation and decoupling of mechanical shock and thermal loads is achieved by the differential encasing of the two zones using two different materials. Namely, the carrier arrangement in the pyrotechnic zone is at least partially coated or encased with a shock absorbing elastic first material, while the carrier arrangement in the electronic zone is enclosed or encased with a second material that is harder than the shock absorbing first material of the pyrotechnic zone. This harder encasing of the electronic zone achieves a protection and a separation of the electronic assembly from the pyrotechnic zone, while the softer elastic encasing of the pyrotechnic zone additionally provides a shock absorbing effect that further diminishes the transmission of mechanical shock forces or other loads from the pyrotechnic zone into the electronic zone, and particularly into the electronic assembly. With such an arrangement, it is possible to omit an additional partition wall or separating protective wall between the electronic zone and the pyrotechnic zone.

The carrier arrangement further preferably comprises decoupling or parting features at a decoupling or parting location, for separating the pyrotechnic zone from the rest of the carrier arrangement, so that the excess forces that cannot be taken-up by the shock absorbing encasing at least will not be transmitted through the carrier arrangement to the electronic assembly.

In a preferred embodiment, the decoupling or parting features and/or the elastic encasing of the carrier arrangement in the pyrotechnic zone are so dimensioned, configured, and embodied, so that they will separate the carrier arrangement only when a thermal and/or mechanical load arising in the pyrotechnic zone or exerted on the carrier arrangement during the burning of the pyrotechnic charge exceeds a prescribed thermal and/or mechanical load threshold.

BRIEF DESCRIPTION OF THE DRAWINGS

In order that the invention may be clearly understood, it will now be described in connection with an example embodiment, with reference to the accompanying drawings, wherein.

DETAILED DESCRIPTION OF PREFERRED EXAMPLE EMBODIMENTS AND OF THE BEST MODE OF THE INVENTION

Figure 1:
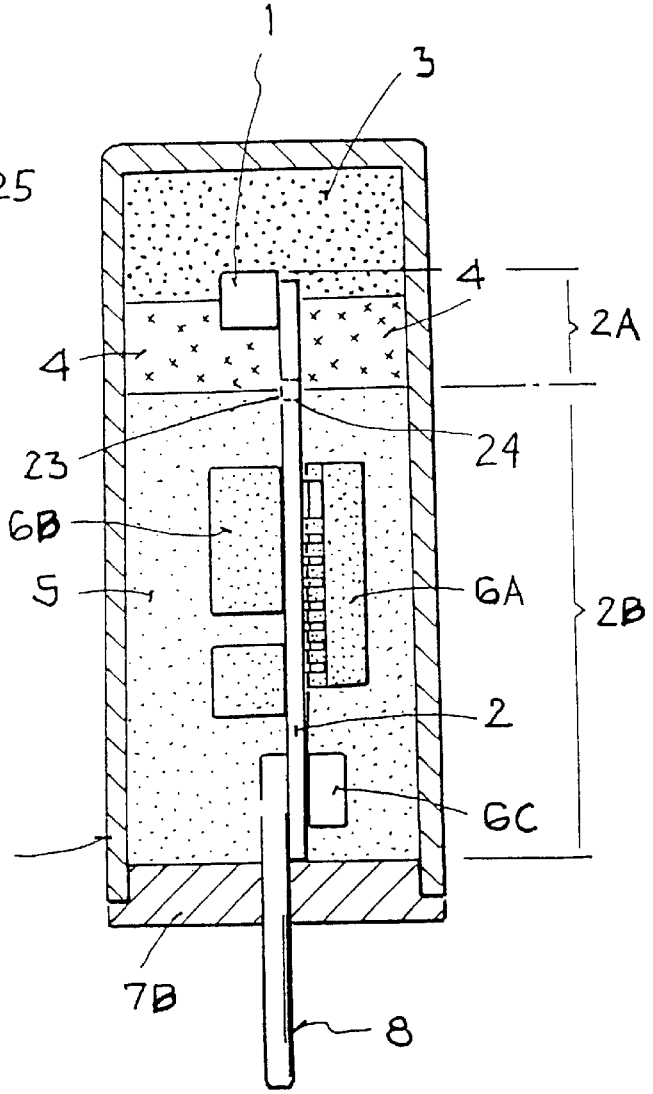
FIG. 1 is a sectional view of an especially preferred embodiment of the igniter arrangement according to the invention.

FIG. 1 shows an especially preferred embodiment of an igniter arrangement which may, for example, be used as the igniter for a gas generator of a passenger or occupant protection device, e.g. an airbag, in a motor vehicle. The igniter arrangement comprises a two-part housing 7A, 7B including a housing canister 7A and a housing lid 7B, a carrier arrangement or substrate 2, an ignition bridge 1 arranged on and electrically connected with the carrier arrangement 2, a pyrotechnic charge or active mass 3 arranged and adapted to be ignited by the ignition bridge 1, and an electronic assembly 6A, 6B, 6C, including various electronic components 6A, 6B, 6C, mounted on and electrically connected with the carrier arrangement 2 and adapted to electrically trigger or energize the ignition bridge 1.

The igniter arrangement is divided into a pyrotechnic area or zone A and an electronic area or zone B, whereby the ignition bridge 1 and a first portion 2A of the carrier arrangement or substrate 2, and possibly also at least a part of the pyrotechnic charge 3, are arranged in the pyrotechnic zone A, while a second portion 2B of the carrier arrangement 2 as well as the electronic components 6A, 6B, 6C mounted thereon are arranged in the electronic zone B. The ignition bridge 1 may be directly mounted on the carrier arrangement 2, but preferably is not directly mounted on the carrier arrangement 2, but rather on a separate carrier body which in turn is mounted on the carrier arrangement 2.

The carrier arrangement 2 is preferably further at least partially surrounded or enclosed by a pressure or shock absorbing first material 4 in the pyrotechnic zone A. This pressure absorbing first material 4, for example embodied in the manner of a so-called "soft glob top", has a certain plastic or elastic deformability, which serves to absorb and dissipate mechanical forces and thereby protect the first portion 2A of the carrier arrangement 2 located in the pyrotechnic zone A from mechanical shock loads arising from the burning of the pyrotechnic charge 3.

Moreover, the pyrotechnic zone A is additionally separated from the electronic zone B, in that the electronic zone B is provided with a potting or encasing of a pressure resistant and heat resistant second material 5, which is harder than the above mentioned pressure and shock absorbing first material 4 forming the potting or encasing in the pyrotechnic zone A. Thus, a two-part differentiated potting or encasing of the overall carrier arrangement 2 is formed, with the pyrotechnic zone A separated and distinguished from the electronic zone B, in view of the distinct first and second materials 4 and 5 used for encasing these two zones. This separation of the two zones is achieved without requiring a separate partition wall or protective wall between the two zones. In other words, the division or separation between the pyrotechnic zone A and the electronic zone B is simply formed by the interface between the softer first material 4 and the harder second material 5, without having a distinct physical partition wall as a separate element therebetween. Preferably, the potting or encasing in both zones is carried out as a complete filling and potting of the available space within the housing 7A, i.e. completely filling out to the side walls of the housing 7A.

Further in this context, the electronic zone B of the carrier arrangement 2 is preferably spaced away from the pyrotechnic charge or active mass 3. Particularly, in a preferred embodiment, the carrier arrangement 2 has an elongated form, whereby the first portion 2A of the carrier arrangement 2 is at one end thereof at which the ignition bridge 1 is arranged, while the electronic zone B is spaced away from the first end of the carrier arrangement 2, and particularly arranged on the second portion 2B of the carrier arrangement 2 opposite the above mentioned first end of the carrier arrangement 2. The pyrotechnic charge 3 is arranged adjacent to the first end of the carrier arrangement 2, and is operatively connected with the ignition bridge 1 only at this first end. Thereby, the greatest distance or spacing separation can be achieved between the pyrotechnic charge 3 and the electronic assembly 6A, 6B, 6C.

Moreover, along its elongated form, the carrier arrangement 2, beginning from the first end at the pyrotechnic charge 3, is first completely enclosed by a softer shock and pressure absorbing material 4, for example a so-called soft glob top, out to the wall of the housing 7A, and then after or behind a prescribed interface boundary, the remainder of the carrier arrangement 2 is completely encased in a relatively harder and thus more pressure resistant and preferably also heat resistant second material 5. In this manner, the softer first material 4 absorbs the shock or mechanical forces generated by the ignition and burning of the pyrotechnic charge 3, while the harder second material 5 very effectively protects the electronic assembly 6A, 6B, 6C from the remaining influences that penetrate through the first material 4 from the ignition and burning of the pyrotechnic charge 3. In other words, the pressure absorbing first material 4 preferably forms a buffer or cushion between the pyrotechnic charge 3 and the electronic zone B which is encased in the harder second material 5.

Throughout this specification, terms such as "temperature resistant", "heat resistant", and "pressure resistant" refer to a material that is able to withstand the temperatures and pressures that normally arise in the igniter arrangement upon the ignition of the pyrotechnic charge 3, while still providing its required functions and properties, and terms such as "pressure absorbing" and "shock absorbing" refer to a material that is able to elastically or plastically absorb and damp forces or pressure applied thereto by the ignition of the pyrotechnic charge.

The structural configuration of the inventive igniter arrangement, including the carrier arrangement 2 with two distinct encasings 4 and 5 in a housing 7A, whereby the two encasings 4 and 5 are successively arranged along the length of the carrier arrangement 2 and become respectively successively harder, provides an extremely compact, robust and easily manufacturable structure, which may be fabricated using any known casting, pour-molding or injection-molding processes as well as any suitable conventionally known potting, molding, or casing materials. The electronic assembly 6A, 6B, 6C and the ignition bridge 1 are simply mounted on the carrier substrate 2, which is then placed into the housing cannister 7A, along with the pyrotechnic charge 3, and thereafter the first material 4 and then the second material 5 are filled into the remaining hollow space within the housing cannister 7A so as to completely fill up this hollow space. Then, an end cap or lid 7B is secured onto the housing canister 7A, with the electrical contact pins 8 of the assembly protruding therethrough. This forms an overall sealed and pressure-tight unit.

In the particular preferred embodiment shown in the drawings, the carrier arrangement 2 further comprises at least one decoupling or parting location with a decoupling or parting feature 23, 24, 25 for separating the first portion 2A of the carrier arrangement 2 located in the pyrotechnic zone A from the rest, i.e. the second portion 2B, of the carrier arrangement 2 after the pyrotechnic charge 3 has been ignited. In this context, the parting feature is preferably so dimensioned, configured, arranged, and embodied, that the carrier arrangement 2 will be separated along the parting location only when the thermal and/or mechanical loads applied thereto exceed a prescribed thermal and/or mechanical load threshold during the burning of the pyrotechnic charge 3.

The complete achieved separation of the carrier arrangement or substrate at the parting location can be detected by means of the remaining interrupted conductor ends on the carrier arrangement 2, such as a circuit board. This physical separation or parting of the carrier arrangement 2 at the parting location ensures that no forces, or at least no forces exceeding the load threshold, are transmitted through the carrier arrangement 2 from the pyrotechnic zone A to the electronic zone B and particularly to the electronic components making up the electronic assembly 6A, 6B, 6C.

Figure 2:
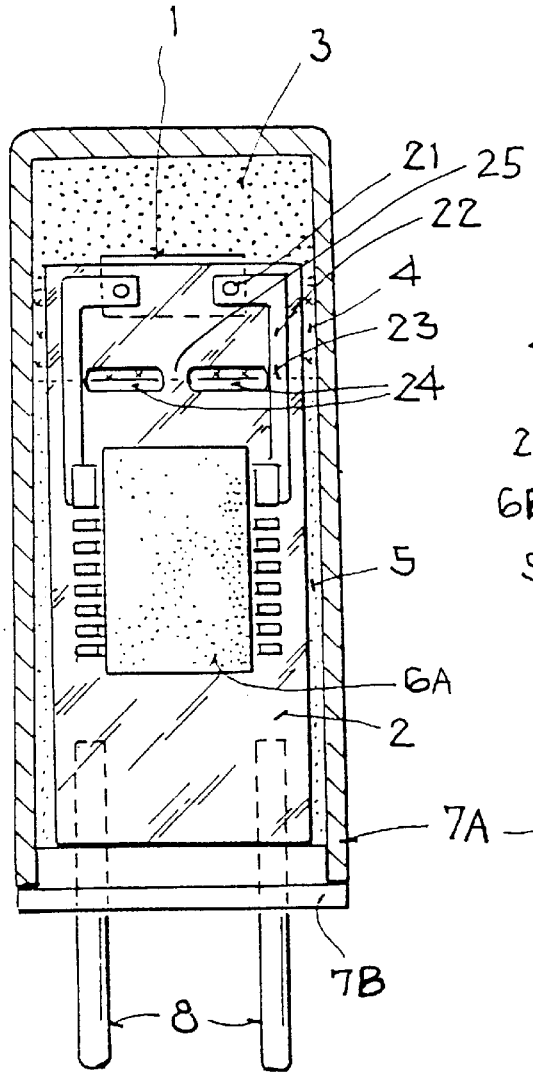
FIG. 2 is another sectional view of the arrangement of FIG. 1, as seen from the right side of FIG. 1 on a section plane perpendicular to that of FIG. 1.

The carrier arrangement or substrate 2 may, for example, be made of ceramic material with suitable metal layers deposited thereon to form conductor path structures 22 and contact zones 21, e.g. in the manner of any typically known circuit board, and the decoupling or parting feature 23, 24, 25 can be embodied in this substrate as a frangible or intentionally breakable link between the two portions 2A and 2B of the carrier arrangement 2, as shown in the side view of FIG. 1, and the front elevation view of FIG. 2.

Particularly, in the illustrated embodiment of FIGS. 1 and 2, two cut-out oblong holes 24 are provided in the carrier substrate 2 along the parting line 23, so as to weaken the structure of the carrier substrate 2 at this location, so that the substrate will break along the parting line 23 if a load exceeding the designed load threshold is applied to the first portion 2A of the substrate relative to the second portion 2B thereof. The load threshold can be selected during fabrication, based on the dimensions, configuration, number, and placement of the holes 24, for example, and the corresponding characteristics of the frangible links or integral tabs 25 remaining to interconnect the two portions 2A and 2B of the substrate between the holes 24.

The electronic assembly 6A, 6B, 6C comprises electronic components or elements 6A for controlling the igniter arrangement via an energy and databus, with which the igniter arrangement is connected by means of contacts or pins 8, a protective circuit 6C that provides protection against interferences on the data bus, and an ignition energy reserve or store, especially an ignition capacitor 6B, as well as any suitable additional electronic circuit components or elements. The particular make-up of the electronic assembly is not critical for the invention, and it may be in accordance with any conventionally known electronic assembly for an igniter arrangement. It is simply important that the electronic assembly is arranged on the second portion 2B of the carrier arrangement 2 so that after decoupling or separation of the parting feature 23, 24, 25 at the parting location, to separate the pyrotechnic first portion 2A of the carrier arrangement 2 with the ignition bridge 1 from the remainder of the carrier arrangement 2, the electronic assembly can still carry out its other functions, for example especially a self-diagnosis function as well as databus communication, and at least will not hinder or interfere with the external data exchange on the bus system.

As mentioned above, the embodiment of FIGS. 1 and 2 may involve an integral one-piece substrate 2 as the carrier arrangement, with merely a weakened area forming the parting or decoupling feature 23, 24, 25 at the parting location. Alternatively, the carrier arrangement 2 may comprise two separate substrate portions or members 2A and 2B, that are connected to each other along the parting location, for example by a soldered connection that is established during the assembly or installation of the igniter arrangement. Due to the heat generated during the burning of the pyrotechnic charge 3, the soldered connection along the parting location will melt or soften so as to achieve a separation or decoupling and thereby prevent the further transmission of loads from the first portion 2A to the second portion 2B of the carrier arrangement 2.

In this embodiment, the at least one solder connection is so dimensioned and embodied (e.g. with a suitable solder material) so that it is able to withstand the mechanical and thermal demands that arise in the motor vehicle field of application, and also is able to conduct the required ignition current to the ignition bridge 1, without melting or softening. However, the mechanical and thermal energy being released by the burning of the ignited pyrotechnic charge 3 is significantly greater than the ordinary mechanical and thermal operating loads, so that the at least one solder connection can be initially dimensioned and embodied with an adequate safety factor above the expected operating loads, while still ensuring a proper separation or decoupling once the pyrotechnic charge 3 is ignited. This is especially true because merely a softening, without complete melting, of the soldered connection is sufficient to bring about a decoupling that prevents the further transmission of forces from the pyrotechnic zone A to the electronic zone B through the parting location of the carrier arrangement 2.

As mentioned above, the pressure absorbing first material of the encasing 4 in the pyrotechnic zone A, for example embodied as a soft glob top, by means of its certain plastic or elastic deformability, protects both the first portion 2A of the carrier arrangement 2 located in the pyrotechnic zone A as well as the encasing 5 in the electronic zone B from the pressure forces or shock generated by the burning pyrotechnic charge 3. Therefore, the pressure resistance or strength of the protective encasing 5 can be reduced when using such a pressure absorbing material 4, or the total security and reliability of the overall arrangement can be correspondingly increased. The pressure absorbing material 4 is preferably sufficiently elastic so that the parting or decoupling feature 23, 24, 25 at the parting location will be separated, without hindrance from the pressure absorbing material 4, at least when the load on the pyrotechnic first portion 2A of the carrier arrangement 2 exceeds the acceptable load threshold.

The length of the first portion 2A of the carrier arrangement 2 in the pyrotechnic zone A is shorter than the length of the second portion 2B of the carrier arrangement 2 in the electronic zone B. This provides an improved lever effect such that the shorter first portion 2A can be reliably separated from the longer second portion 2B at the parting location in the event of an excessive load being applied thereto.

The parting or decoupling features 23, 24, 25 are preferably located on the carrier arrangement 2 in a transition area between the pyrotechnic zone A and the remaining portion of the carrier arrangement enclosed by the encasing of second material 5.

A pyrotechnic igniter arrangement as described herein is especially used for igniting passenger or occupant protection devices of an occupant protection system in a motor vehicle, whereby the occupant protection devices are connected with one another and with a central unit for carrying out a data exchange via a data bus. The electronic assembly especially includes an integrated communication circuit that carries out the data exchange via the data bus, whereby this communication circuit shall remain functional, for example to carry out a data communication, even after the igniter arrangement has been ignited.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A pyrotechnic igniter arrangement comprising:

a carrier arrangement including a first portion defining a pyrotechnic zone of said igniter arrangement and a second portion defining an electronic zone of said igniter arrangement;

an electronic assembly including at least one electronic component arranged on said second portion of said carrier arrangement in said electronic zone;

an electrically ignitable igniter bridge arranged on said first portion of said carrier arrangement in said pyrotechnic zone;

a pyrotechnic charge arranged in or adjacent to said pyrotechnic zone and operatively connected with said igniter bridge to be ignited thereby;

a shock absorbing elastic first material covering at least a part of said first portion of said carrier arrangement in said pyrotechnic zone; and a harder second material that is harder than said first material, and that at least partially encases said second portion of said carrier arrangement in said electronic zone.

2. The pyrotechnic igniter arrangement according to claim 1, wherein at least a part of said igniter bridge is not covered with said first material, and is exposed from said first material to be in contact with said pyrotechnic charge.

3. The pyrotechnic igniter arrangement according to claim 2, further comprising a housing enclosing a space therein;

wherein said carrier arrangement, said electronic assembly, said igniter bridge, and said pyrotechnic charge are received in said space in said housing and leave unoccupied therein a first partial space of said space in said pyrotechnic zone within said housing and a second partial space of said space in said electronic zone within said housing; and wherein said shock absorbing elastic first material completely fills said first partial space and said harder second material completely-fills said second partial space.

4. The pyrotechnic igniter arrangement according to claim 3, wherein said shock absorbing elastic first material forms a continuous buffer between said pyrotechnic charge and said harder second material.

5. The pyrotechnic igniter arrangement according to claim 4, wherein said electronic assembly is completely encased in said harder second material.

6. The pyrotechnic igniter arrangement according to claim 2, wherein said carrier arrangement has an elongated form with opposite first and second ends, said first portion terminates at said first end, said second portion terminates at said second end, said igniter bridge is arranged directly at said first end, only said first end of said carrier arrangement is in contact and operative connection with said pyrotechnic charge which is arranged adjoining said first end of said carrier arrangement and extending therefrom in a direction away from said second end, and said electronic assembly is arranged on said second portion of said carrier arrangement spaced away from said first end.

7. The pyrotechnic igniter arrangement according to claim 1, wherein said carrier arrangement has a parting feature between said first portion and said second portion adapted to separate said first portion from said second portion after said pyrotechnic charge is ignited.

8. The pyrotechnic igniter arrangement according to claim 7, wherein said parting feature comprises an intended rated breaking feature.

9. The pyrotechnic igniter arrangement according to claim 8, wherein at least one of said intended rated breaking feature and said first material is so dimensioned, arranged, configured and embodied so that said intended rated breaking feature will break so as to separate said first portion from said second portion of said carrier arrangement only when at least one of a mechanical load and a thermal load arising during burning of said pyrotechnic charge exceeds a corresponding prescribed mechanical load threshold or thermal load threshold respectively.

10. The pyrotechnic igniter arrangement according to claim 1, wherein said first portion of said carrier arrangement in said pyrotechnic zone has a shorter length than said second portion of said carrier arrangement in said electronic zone.

11. The pyrotechnic igniter arrangement according to claim 1, expressly excluding a partition wall between said pyrotechnic zone and said electronic zone, wherein said first material and said second material directly contact one another along an interface therebetween, which forms a boundary between said pyrotechnic zone and said electronic zone.

12. The pyrotechnic igniter arrangement according to claim 1, wherein said first material forms a soft glob top covering at least a major part of said first portion of said carrier arrangement in said pyrotechnic zone, and said second material comprises a relatively hard potting compound encasing said second portion of said carrier arrangement and said electronic assembly in said electronic zone.

13. A pyrotechnic igniter arrangement comprising:

a housing enclosing therein a space including a first partial space, a second partial space and a third partial space;

a carrier substrate arranged in said housing and extending at least in said second partial space and said third partial space;

a pyrotechnic charge arranged in said first partial space;

an electrically ignitable igniter that is arranged on said carrier substrate in said second partial space and that is operatively connected with said pyrotechnic charge so as to be able to ignite said pyrotechnic charge;

an electronic assembly including at least one electronic component arranged on said carrier substrate in said third partial space;

a shock absorbing elastic first material disposed in said second partial space so as to encase at least a part of said carrier substrate in said second partial space; and a harder second material that is harder than said first material and that is disposed in said third partial space so as to encase at least a part of said electronic assembly in said third partial space.

14. The pyrotechnic igniter arrangement according to claim 13, wherein said first material forms a barrier and a buffer between said pyrotechnic charge and said second material.

15. The pyrotechnic igniter arrangement according to claim 13, wherein said first material entirely fills a remainder of said second partial space, and said second material entirely fills a remainder of said third partial space so as to entirely encase said electronic assembly on said carrier substrate.

* * * * *